US010065284B2

(12) United States Patent
Xue et al.

(10) Patent No.: US 10,065,284 B2
(45) Date of Patent: Sep. 4, 2018

(54) ONLINE GENERAL VEHICLE WHEEL DEBURRING DEVICE

(71) Applicant: CITIC Dicastal CO., LTD, Qinhuangdao (CN)

(72) Inventors: Bowen Xue, Qinhuangdao (CN); Jiandong Guo, Qinhuangdao (CN)

(73) Assignee: CITIC DICASTAL CO., LTD (CN)

( * ) Notice: Subject to any disclaimer, the term of this patent is extended or adjusted under 35 U.S.C. 154(b) by 107 days.

(21) Appl. No.: 15/383,526

(22) Filed: Dec. 19, 2016

(65) Prior Publication Data

US 2017/0182616 A1 Jun. 29, 2017

(30) Foreign Application Priority Data

Dec. 29, 2015 (CN) ..... 2015 1 1006526

(51) Int. Cl.

| | |
|---|---|
| ***H04N 7/18*** | (2006.01) |
| ***B24B 9/04*** | (2006.01) |
| ***B24B 29/00*** | (2006.01) |
| ***B24B 29/04*** | (2006.01) |

(52) U.S. Cl.

CPC ..... *B24B 9/04* (2013.01); *B24B 29/005* (2013.01); *B24B 29/04* (2013.01)

(58) Field of Classification Search

CPC ..... B24B 9/04; B24B 29/00; B24B 29/005; B24B 3/40; B24B 3/463; B24B 49/12

USPC ..... 348/86, 148

See application file for complete search history.

(56) References Cited

U.S. PATENT DOCUMENTS 9,393,662 B2 * 7/2016 Schroeder ..... B24B 3/40
9,833,873 B2 * 12/2017 Xue ..... B24B 29/005

* cited by examiner

*Primary Examiner* — Andy Rao
(74) *Attorney, Agent, or Firm* — Calfee, Halter & Griswold LLP

(57) ABSTRACT

The present invention discloses an online general vehicle wheel deburring device comprising a frame, an air cylinder, a guide rail, a servo electric cylinder and the like, wherein a vehicle wheel on a roller way is initially positioned by a sensor, a clamping cylinder clamps the vehicle wheel by using four V-shaped rollers by virtue of gears, gear racks and the guide rails IV, and the vehicle wheel is rotated in a clamping state under the action of a driving motor; the angle of a brush can be randomly adjusted by the servo electric cylinder I by virtue of the guide rail the angle of the brush can be randomly adjusted by the servo electric cylinder II by virtue of the guide rail I; the lifting height of the brush can be adjusted by the lift cylinder by virtue of the guide rail III.

1 Claim, 2 Drawing Sheets

ONLINE GENERAL VEHICLE WHEEL DEBURRING DEVICE

CROSS-REFERENCE TO RELATED APPLICATIONS

This application claims priority to Chinese Patent Application No. 201511006526.1, filed on Dec. 29, 2015, which is hereby incorporated by reference in its entirety.

TECHNICAL FIELD

The present invention relates to a deburring device, in particular to an online deburring device for a back cavity of a vehicle wheel.

BACKGROUND ART

In the production course of aluminum alloy vehicle wheels, removing burrs on a back cavity after machining is an important procedure. In the present common method, deburring is performed on the back cavity with a large disc brush on special equipment; when the manner is adopted, the burr removing effect is poor for vehicle wheels with complex modeling, and only manual grinding is performed to meet requirements. At present, a deburring device with high automation degree, which not only can adapt to deburring requirements for any complex modeling but also can perform focused treatment on a certain specific location, and with good stability, does not exist. The present invention provides a novel device which has high generality and can realize online production.

SUMMARY OF THE INVENTION

The present invention aims to provide an online general vehicle wheel deburring device which can meet deburring requirements for a back cavity of a vehicle wheel with any modeling.

In order to achieve the purpose, a technical solution of the present invention is as follows: the online general vehicle wheel deburring device comprises a frame, a bottom plate, a guide rail I, a sliding plate, a guide rail II, a sliding block, a supporting rod, a roll-over stand, a lifting cylinder, a guide rail III, a servo motor, a lifting plate, a belt pulley I, a synchronous belt, a supporting block, a guide rail IV, gears, a supporting plate, a brush, a belt pulley II, a bearing base I, a servo electric cylinder I, a servo electric cylinder II, gear racks, a left sliding table, a bearing base II, a shaft I, V-shaped rollers, a right sliding table, a clamping cylinder, a driving motor, a pin shaft, rolling bearings and a shaft II. The bottom plate is fixed below the frame. The sliding plate is mounted above the bottom plate by the guide rail I. The servo electric cylinder II is also fixed above the bottom plate, and the output end of the servo electric cylinder II is connected with the sliding plate. The sliding block is mounted above the sliding plate by the guide rail II. Two supporting rods and the servo electric cylinder I are also fixed above the sliding plate, and the output end of the servo electric cylinder I is connected with the sliding block. The lower part of the roll-over stand is hinged to the sliding block, T-shaped grooves in two sides are matched with the outer rings of the rolling bearings, the rolling bearings are mounted at the top end of the pin shaft, and the pin shaft is fixed at the inner sides of the two supporting rods. The lifting plate is mounted above the roll-over stand by the guide rail III. The lifting cylinder is also fixed above the roll-over stand, and the output end of the lifting cylinder is connected with the lower end of the lifting plate. The servo motor is fixed to the lower end of the lifting plate, wherein the belt pulley I is mounted at the output end of the servo motor. The bearing base I is fixed at the upper end of the lifting plate. The shaft II is mounted in the bearing base I by a bearing, wherein the brush and the belt pulley II are mounted on the shaft II. The belt pulley I and the belt pulley II are connected by the synchronous belt.

The left sliding table and the right sliding table are mounted above the supporting plate by the supporting blocks and the guide rails IV. The gear racks are respectively fixed below the left sliding table and the right sliding table, and the gear racks are engaged with gears fixed above the supporting plate. The bearing bases II are respectively fixed above the left sliding table and the right sliding table. The shafts I are mounted in the bearing bases II, wherein the V-shaped rollers are fixed above the shafts I. The clamping cylinder is fixed at the right side of the frame, and the output end of the clamping cylinder is connected with the right sliding table. The driving motor is fixed below the right sliding table, and the output end of the driving motor is connected with the lower part of one of the shafts I.

During actual use, a vehicle wheel on a roller way is initially positioned by a sensor, the clamping cylinder clamps the vehicle wheel by using four V-shaped rollers by virtue of the gears, the gear racks and the guide rails IV, and the vehicle wheel rotates in a clamping state under the action of the driving motor. The angle of the brush can be randomly adjusted by the servo electric cylinder I by virtue of the guide rail II. The position of the brush randomly can be randomly adjusted by the servo electric cylinder II by virtue of the guide rail I. The lifting cylinder can adjust the lifting height of the brush by the guide rail III. The servo motor drives the brush to rotate, and burrs can be removed when the brush is in contact with the back cavity of the rotating vehicle wheel.

During use, the invention can meet deburring requirements for the back cavity of the vehicle wheel with any modeling, the position of the brush can be adjusted randomly, and focused treatment on a certain location can be realized. Besides, the device has the characteristics of being high in generality, advanced in technology, high in automation degree and safe and stable in performance.

Figure 1:
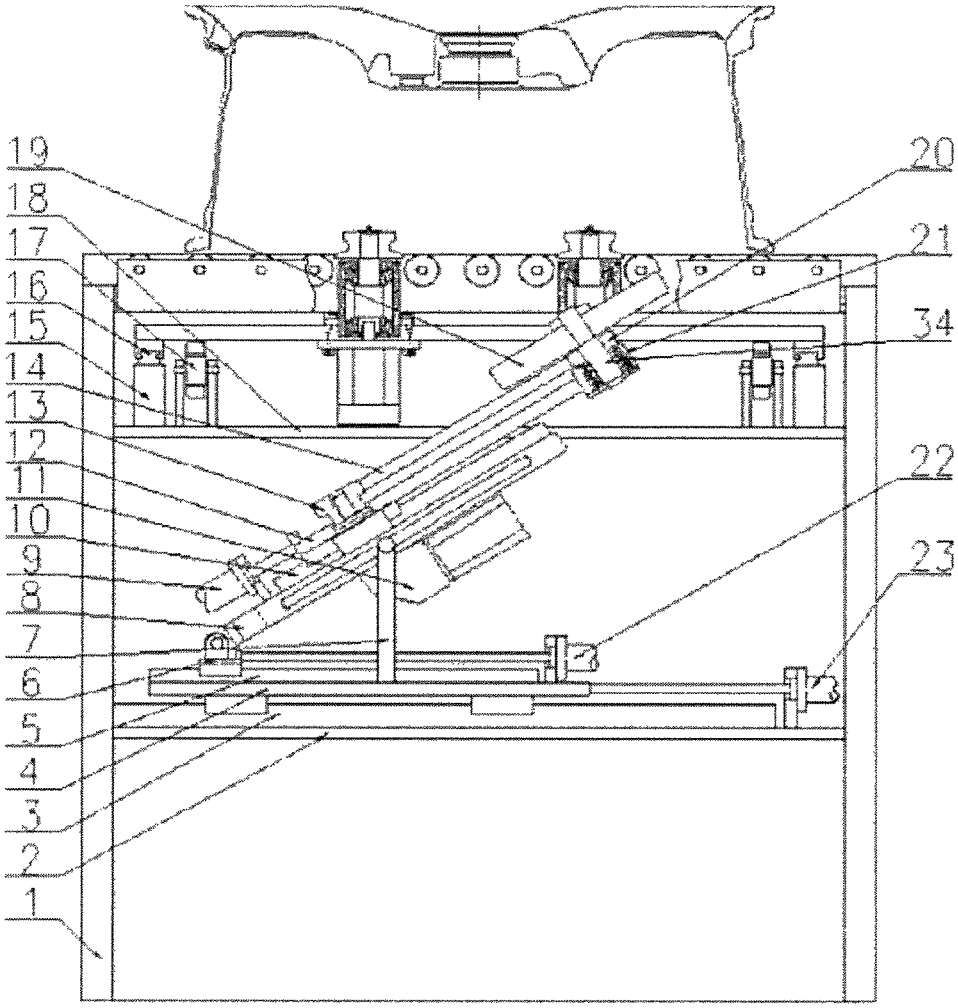
FIG. 1 is a left view of the online general vehicle wheel deburring device of the present invention.
Figure 2:
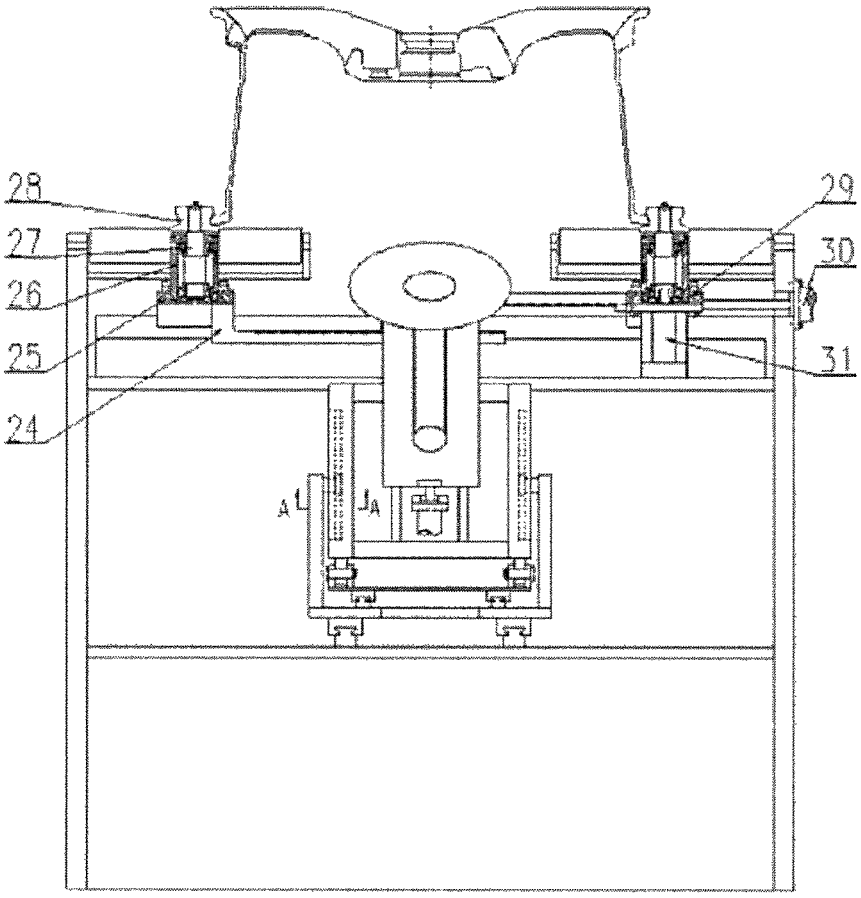
FIG. 2 is a front view of the online general vehicle wheel deburring device of the present invention.
Figure 3:
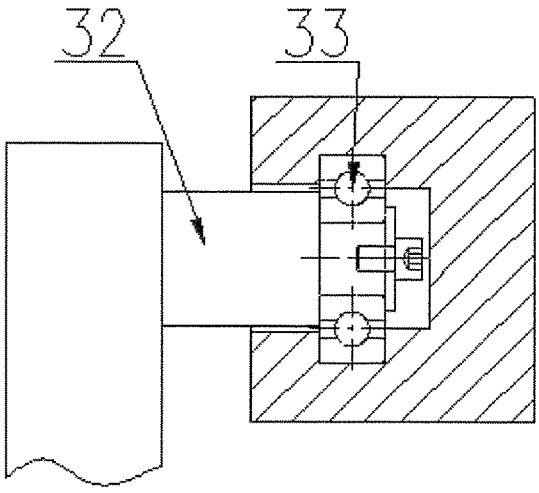
FIG. 3 is an A-direction partial sectioned view of the online general vehicle wheel deburring device of the present invention.

In the figures, 1—frame, 2—bottom plate, 3—guide rail I, 4—sliding plate, 5—guide rail II, 6—sliding block, 7—supporting rod, 8—roll-over stand, 9—lifting cylinder, 10—guide rail III, 11—servo motor, 12—lifting plate, 13—belt pulley I, 14—synchronous belt, 15—supporting block, 16—guide rail IV, 17—gear, 18—supporting plate, 19—brush, 20—belt pulley II, 21—bearing base I, 22—servo electric cylinder I, 23—servo electric cylinder II, 24—gear rack, 25—left sliding table, 26—bearing base II, 27—shaft I, 28—V-shaped roller, 29—right sliding table,

30—clamping cylinder, 31—driving motor, 32—pin shaft, 33—rolling bearing, 34—shaft II

DETAILED DESCRIPTION OF THE INVENTION

In the following, the details and working conditions of a specific device provided by the present invention are described in detail in combination with figures.

The device comprises a frame 1, a bottom plate 2, a guide rail I 3, a sliding plate 4, a guide rail II 5, a sliding block 6, a supporting rod 7, a roll-over stand 8, a lifting cylinder 9, a guide rail III 10, a servo motor 11, a lifting plate 12, a belt pulley I 13, a synchronous belt 14, a supporting block 15, a guide rail IV 16, gears 17, a supporting plate 18, a brush 19, a belt pulley II 20, a bearing base I 21, a servo electric cylinder I 22, a servo electric cylinder II 23, gear racks 24, a left sliding table 25, a bearing base II 26, a shaft I 27, V-shaped rollers 28, a right sliding table 29, a clamping cylinder 30, a driving motor 31, a pin shaft 32, rolling bearings 33 and a shaft II 34, wherein the bottom plate 2 is fixed below the frame 1; the sliding plate 4 is mounted above the bottom plate 2 by the guide rail I 3; the servo electric cylinder II 23 is also fixed above the bottom plate 2, and the output end of the servo electric cylinder II 23 is connected with the sliding plate 4; the sliding block 6 is mounted above the bottom plate 4 by the guide rails II 5; the two supporting rods 7 and the servo electric cylinder I 22 are also fixed above the sliding plate 4, and the output end of the servo electric cylinder I 22 is connected with the sliding block 6; the lower part of the roll-over stand 8 is hinged to the sliding block 6, T-shaped grooves on two sides are matched with the outer rings of the rolling bearings 33, the rolling bearings 33 are mounted at the top end of the pin shaft 32, and the pin shaft 32 is fixed at the inner side of the two supporting rods 7; the lifting plate 12 is mounted above the roll-over stand 8 by the guide rail III 10; the lifting cylinder 9 is also fixed above the roll-over stand 8, and the output end of the lifting cylinder 9 is connected with the lower end of the lifting plate 12; the servo motor 11 is fixed at the lower end of the lifting plate 12, and the belt pulley I 13 is mounted at the output end of the servo motor 11; the bearing base I 21 is fixed at the upper end of the lifting plate 12; the shaft II 34 is mounted in the bearing base I 21 by a bearing, and the brush 19 and the belt pulley II 20 are mounted on the shaft II 34; the belt pulley I 13 and the belt pulley II 20 are connected by the synchronous belt 14.

The left sliding table 25 and the right sliding table 29 are mounted above the supporting block 18 by the supporting blocks 15 and the guide rails IV 16; the gear racks 24 are fixed below the left sliding table 25 and the right sliding table 29, and the gear racks 24 are engaged with the gears 17 fixed above the supporting plate 18; the bearing bases II 26 are respectively fixed above the left sliding table 25 and the right sliding table 29; the shafts I 27 are mounted in the bearing bases II 26, and the V-shaped rollers 28 are fixed above the shafts I 27; the clamping cylinder 30 is fixed at the right side of the frame 1, and the output end of the clamping cylinder 30 is connected with the right sliding table 29; the driving motor 31 is fixed below the right sliding table 29, and the output end of the driving motor 31 is connected with the lower part of one of the shafts I 27.

During actual use, a vehicle wheel on a roller way is initially positioned by a sensor, the clamping cylinder 30 clamps the vehicle wheel by using the four V-shaped rollers 28 by virtue of the gears 17, the gear racks 24 and the guide rails IV 16, and the vehicle wheel rotates in a clamping state under the action of the driving motor 31. The angle of the brush 19 can be randomly adjusted by the servo electric cylinder I 21 by virtue of the guide rail II 5. The angle of the brush 19 can be randomly adjusted by the servo electric cylinder II 22 by virtue of the guide rail I 3. The lifting height of the brush 19 can be adjusted by the lifting cylinder 9 by virtue of the guide rail III 10. The servo motor 11 drives the brush 19 to rotate, and burrs can be removed when the brush 19 is in contact with the back cavity of the rotating vehicle wheel.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An online general vehicle wheel deburring device, comprising a frame, a bottom plate, a guide rail I, a sliding plate, a guide rail II, a sliding block, a supporting rod, a roll-over stand, a lifting cylinder, a guide rail III, a servo motor, a lifting plate, a belt pulley I, a synchronous belt, a supporting block, a guide rail IV, gears, a supporting plate, a brush, a belt pulley II, a bearing base I, a servo electric cylinder I, a servo electric cylinder II, gear racks, a left sliding table, a bearing base II, a shaft I, V-shaped rollers, a right sliding table, a clamping cylinder, a driving motor, pin shafts, rolling bearings and a shaft II, characterized in that the bottom plate is fixed below the frame; the sliding plate is mounted above the bottom plate by the guide rail I; the servo electric cylinder II is also fixed above the bottom plate, and the output end of the servo electric cylinder is connected with the sliding plate; the sliding block is mounted above the sliding plate by the guide rail II; two supporting rods and the servo electric cylinder I are also fixed above the sliding plate, and the output end of the servo electric cylinder I is connected with the sliding block; the downside of the roll-over stand is hinged with the sliding block, T-shaped grooves formed at two sides of the roll-over stand are matched with the outer rings of the rolling bearings mounted at the top ends of the pin shafts, and the pin shafts are fixed at the inner sides of the two supporting rods; the lifting plate is mounted above the roll-over stand by the guide rail III; the lifting cylinder is also fixed above the roll-over stand, and the output end of the lifting cylinder is connected with the lower end of the lifting plate; the servo motor of which the output end is provided with the belt pulley I is fixed at the lower end of the lifting plate; the bearing base I is fixed at the upper end of the lifting plate; the shaft II provided with the brush and the belt pulley II is mounted in the bearing base I by a bearing; the belt pulley I is connected with the belt pulley II by the synchronous belt;

the left sliding table and the right sliding table are mounted above the supporting plates by the supporting block and the guide rail IV; the gear racks are fixed below the left sliding table and the right sliding table and are engaged with the gears fixed above the supporting plates; the bearing bases II are respectively fixed above the left sliding table and the right sliding table; the shaft I above which the V-shaped rollers are respectively fixed is mounted in the bearing base II; the clamping cylinder is fixed at the right side of the frame, and the output end of the clamping cylinder is connected with the right sliding table; and the driving motor is fixed below the right sliding table, and the output end of the driving motor is connected with the downside of one of the shafts I.

* * * * *